US011168902B2

(12) United States Patent
Barbely

(10) Patent No.: US 11,168,902 B2
(45) Date of Patent: Nov. 9, 2021

(54) WIND BAFFLE WITH MULTIPLE, VARIABLE AIR VENTS FOR AN AIR-CONDITIONER

(71) Applicant: Mitsubishi Electric US, Inc., Cypress, CA (US)

(72) Inventor: Allen Barbely, Auburn, GA (US)

(73) Assignee: Mitsubishi Electric US, Inc., Cypress, CA (US)

( * ) Notice: Subject to any disclaimer, the term of this patent is extended or adjusted under 35 U.S.C. 154(b) by 263 days.

(21) Appl. No.: 16/556,412

(22) Filed: Aug. 30, 2019

(65) Prior Publication Data

US 2021/0063029 A1 Mar. 4, 2021

(51) Int. Cl.

| | |
|---|---|
| ***F24F 1/58*** | (2011.01) |
| ***F24F 1/48*** | (2011.01) |
| *F24F 13/20* | (2006.01) |
| *F24F 13/14* | (2006.01) |

(52) U.S. Cl.

CPC ..... *F24F 1/58* (2013.01); *F24F 1/48* (2013.01); *F24F 13/1426* (2013.01); *F24F 13/20* (2013.01)

(58) Field of Classification Search

CPC .. F24F 1/58; F24F 1/48; F24F 13/1426; F24F 13/20

See application file for complete search history.

(56) References Cited

U.S. PATENT DOCUMENTS

| | | | | |
|---|---|---|---|---|
| 3,584,466 | A * | 6/1971 | Kaufman | F25D 23/003 62/183 |
| 6,430,954 | B1 | 8/2002 | Smith | |
| 2008/0178624 | A1 | 7/2008 | Zedney | |
| 2012/0036878 | A1 | 2/2012 | Bush | |
| 2012/0103482 | A1* | 5/2012 | Simmons | F28B 1/06 150/165 |
| 2013/0005238 | A1* | 1/2013 | Brandt | F24F 13/14 454/275 |
| 2013/0130611 | A1* | 5/2013 | Dinicolas | F24F 13/20 454/201 |
| 2014/0260363 | A1* | 9/2014 | Bush | F24F 11/76 62/81 |
| 2017/0254602 | A1* | 9/2017 | Bronicki | F28F 13/06 |

FOREIGN PATENT DOCUMENTS

| | | | |
|---|---|---|---|
| CN | 102052748 | A | 5/2011 |
| KR | 200161702 | Y1 | 12/1999 |
| KR | 20000017772 | U | 10/2000 |

* cited by examiner

*Primary Examiner* — Joseph F Trpisovsky
(74) *Attorney, Agent, or Firm* — Posz Law Group, PLC

(57) ABSTRACT

A wind baffle operable to control air movement to an air inlet of an air-conditioner, the wind baffle comprising: a frame defining an inlet side, an outdoor side opposite the inlet side, and a plurality of wall sections between the inlet side and the outdoor side; a back plate formed on the outdoor side; a first variable air vent formed on a first wall section and being configured to selectively pass or restrict a first air flow through the first variable air vent; a second variable air vent formed on a second wall section and being configured to selectively pass or restrict a second air flow through the second variable air vent; and a securing mechanism on the inlet side configured to attach the wind baffle to the air inlet such that the inlet side faces the air inlet, wherein the inlet side is unobstructed, allowing air to pass freely.

24 Claims, 9 Drawing Sheets

WIND BAFFLE WITH MULTIPLE, VARIABLE AIR VENTS FOR AN AIR-CONDITIONER

FIELD OF THE INVENTION

The subject matter described below relates generally to an air baffle for an air-conditioning system. More particularly, the described subject matter relates to an air baffle that includes multiple, variable air vents on different surfaces to allow a user to vary a direction of input air to inlet vents for an air-conditioning system.

BACKGROUND OF THE INVENTION

An outdoor unit in an air-conditioning system operates to draw outdoor air into the outdoor unit, exchange heat between a refrigerant coil and the outdoor air, and then eject the heated or cooled outdoor air back outside of the outdoor unit. When the air-conditioning system is operating in a heating mode, the refrigerant coil in the outdoor unit is at a temperature below that of the outdoor air and operates to draw heat from the outdoor air to heat the refrigerant in the refrigerant coil. When the air-conditioning system is operating in a cooling mode, the refrigerant coil in the outdoor unit is at a temperature above that of the outdoor air and operates to dissipate heat to the outdoor air to cool the refrigerant in the refrigerant coil.

When an air conditioning system using a heat exchanger (e.g., a heat pump) is operating in a cooling mode and the outdoor temperature is extremely low and windy, expelling too much heat to the outdoors could create operating issues with the air conditioning system. In such a situation, the pressure of refrigerant in the refrigerant coil can decrease to an undesirable degree causing operating problems.

Furthermore, air-conditioners that employ heat exchangers become less efficient in a heating operation at low temperatures. Conventionally, heat pumps have been considered to become increasingly inefficient when operating at outside temperatures below freezing (e.g., below about −5° C./23° F.). A major reason for this is that heat pumps operate by drawing heat out of the ambient outdoor air and there are rapidly decreasing amounts of heat in outdoor air as the outdoor temperatures falls below freezing.

In heat exchangers that rely on outdoor air for heat, wind blowing against surface of the refrigerant coil can exacerbate the negative affect that a drop in ambient air temperature below 23° F. (−5° C.) has on system stability and capacity.

Attempts to combat the negative effects of low ambient air temperature and wind have included installing wind guards that restrict airflow to the refrigerant coils of the outdoor unit to allow for more efficient operation at a lower outdoor operating temperature. For example, when an air-conditioner is operating in a cooling mode and it is cold outside, wind guards can modulate, block, or limit the amount of wind that would otherwise increase the amount of heat rejected to the outdoors.

Current wind guards are fixed, one-size-fits-all devices that only provide a single configuration. While they do offer some protection from the wind, they offer no flexibility. Once installed they offer the same wind protection regardless of the prevailing conditions. And if a wind guard is to be used, the same device, which is not optimized for any given device, must serve for multiple outdoor units in different areas with differing amounts, directions, and speeds of wind. As a result, existing wind guards will typically not be as efficient as they could in maximizing the exchange of heat between the refrigerant coil in the outdoor unit and the outdoor air.

It would therefore be desirable to provide a variable wind baffle that can be altered as needed for a variety of installation circumstances.

SUMMARY OF THE INVENTION

A wind baffle is provided that is operable to control movement of air to an air inlet of an air-conditioner, the wind baffle comprising: a frame defining an inlet side, an outdoor side opposite the inlet side, and a plurality of wall sections between the inlet side and the outdoor side; a back plate formed on the outdoor side such that air cannot pass through the outdoor side; a first variable air vent formed on a first of the plurality of wall sections, the first variable air vent being configured to selectively pass or restrict a first air flow though the first variable air vent; a second variable air vent formed on a second of the plurality of wall sections different from the first of the plurality of wall sections, the second variable air vent being configured to selectively pass or restrict a second air flow though the second variable air vent; and a securing mechanism on the inlet side configured to attach the wind baffle to the air inlet such that the inlet side directly faces the air inlet, wherein the inlet side is unobstructed, allowing air to pass freely.

The first variable air vent may include a variable block-off plate configured to take one of a plurality of configurations, each of the plurality of configurations allowing a different amount of air to flow through the first variable air vent.

The variable block-off plate may further comprise: a positioner configured to allow the variable block-off plate to move between the plurality of configurations; and a fastener to secure the variable block-off plate in one of the plurality of configurations.

The positioner may be one of a linear opening in the variable block-off plate, a bolt hole, and a protrusion configured to rest in a corresponding indentation.

The first variable air vent may include an array of louvers configured to take one of a plurality of configurations, each of the plurality of configurations representing a differing degree of opening and allowing a different amount of air to flow through the array of louvers.

The first variable air vent may further comprise: an opening configured to allow passage of air; and a plurality of slats formed to cover the opening, and the plurality of slats are configured such that one or more of the plurality of slats can be removed from the first variable air vent to increase air flow through the first air vent.

The plurality of slats may be configured such that the plurality of slats can be removed from the first variable air vent and can be replaced on the first variable air vent after removal.

The plurality of slats may be configured such that removal of one of the plurality of slats from the first variable air vent cannot be reversed.

The wind baffle may further comprise: a baffle control circuit configured to automatically control at least one of the first and second variable air vents.

The baffle control circuit may include a wind direction sensor configured to detect a wind direction around the wind baffle, and the baffle control circuit may be configured to automatically control at least one of the first and second variable air vents based on the detected wind direction around the wind baffle.

The baffle control circuit may operate in response to baffle control signals received from an air-conditioner controller.

An air-conditioning system is provided, comprising: an outdoor air-conditioner having two or more air inlets for drawing in air, the two or more air inlets each being formed on different sides of the outdoor air-conditioner; a first wind baffle secured to a first air inlet selected from the two or more air inlets such that the first wind baffle completely covers the first air inlet, wherein the first wind baffle further comprises a first frame defining a first inlet side, a first outdoor side opposite the first inlet side, and a first plurality of wall sections between the first inlet side and the first outdoor side; a first back plate formed on the first outdoor side such that air cannot pass through the first outdoor side; a first variable air vent formed on a first of the plurality of first wall sections, the first variable air vent being configured to selectively pass or restrict a first air flow though the first variable air vent; a second variable air vent formed on a second of the first plurality of wall sections different from the first of the plurality of wall sections, the second variable air vent being configured to selectively pass or restrict a second air flow though the second variable air vent; and a first securing mechanism on the first inlet side configured to attach the first wind baffle to the first air inlet such that the first inlet side directly faces the first air inlet, wherein the first inlet side is unobstructed, allowing air to pass freely.

The first variable air vent may include a variable block-off plate configured to take one of a plurality of configurations, each of the plurality of configurations allowing a different amount of air to flow through the first variable air vent.

The variable block-off plate may further comprise: a positioner configured to allow the variable block-off plate to move between the plurality of configurations; and a fastener to secure the variable block-off plate in one of the plurality of configurations.

The positioner may be one of a linear opening in the variable block-off plate, a bolt hole, and a protrusion configured to rest in a corresponding indentation.

The first variable air vent may include an array of louvers configured to take one of a plurality of configurations, each of the plurality of configurations representing a differing degree of opening and allowing a different amount of air to flow through the array of louvers.

The first variable air vent may further comprise: an opening configured to allow passage of air; and a plurality of slats formed to cover the opening, wherein plurality of slats may be configured such that one or more of the plurality of slats can be removed from the first variable air vent to increase air flow through the first air vent.

The plurality of slats may be configured such that the plurality of slats can be removed from the first variable air vent and can be replaced on the first variable air vent after removal.

The plurality of slats may be configured such that removal of one of the plurality of slats from the first variable air vent cannot be reversed.

The air-conditioning system may further comprise: a baffle control circuit configured to automatically control operation of the first variable air vent.

The baffle control circuit may include a wind direction sensor configured to detect a wind direction around the first wind baffle, and the baffle control circuit may be configured to automatically control at first air vent based on the detected wind direction around the first wind baffle.

The air-conditioning system may further comprise an air-conditioner controller configured to control operation of the air-conditioning system, wherein the baffle control circuit operates in response to baffle control signals received from the air-conditioner controller.

The air-conditioning system may further comprise a second wind baffle secured to a second air inlet selected from the two or more air inlets such that the second wind baffle completely covers the second air inlet, wherein the second wind baffle further comprises: a second frame defining a second inlet side, a second outdoor side opposite the second inlet side, and a second plurality of wall sections between the second inlet side and the second outdoor side; a second back plate formed on the second outdoor side such that air cannot pass through the second outdoor side; a third variable air vent formed on a first of the plurality of second wall sections, the third variable air vent being configured to selectively pass or restrict a third air flow though the third variable air vent; a fourth variable air vent formed on a second of the second plurality of wall sections different from the first of the second plurality of wall sections, the fourth variable air vent being configured to selectively pass or restrict a second air flow though the fourth variable air vent; and a second securing mechanism on the second inlet side configured to attach the second wind baffle to the second air inlet such that the second inlet side directly faces the second air inlet, and the second inlet side is unobstructed, allowing air to pass freely.

The air-conditioning system may further comprise a second wind baffle secured to a second air inlet selected from the two or more air inlets such that the second wind baffle completely covers the second air inlet, wherein the second wind baffle entirely prevents air flow through the second air inlet.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Wind Baffle Using Variable Block-Off Plates

Figure 1:
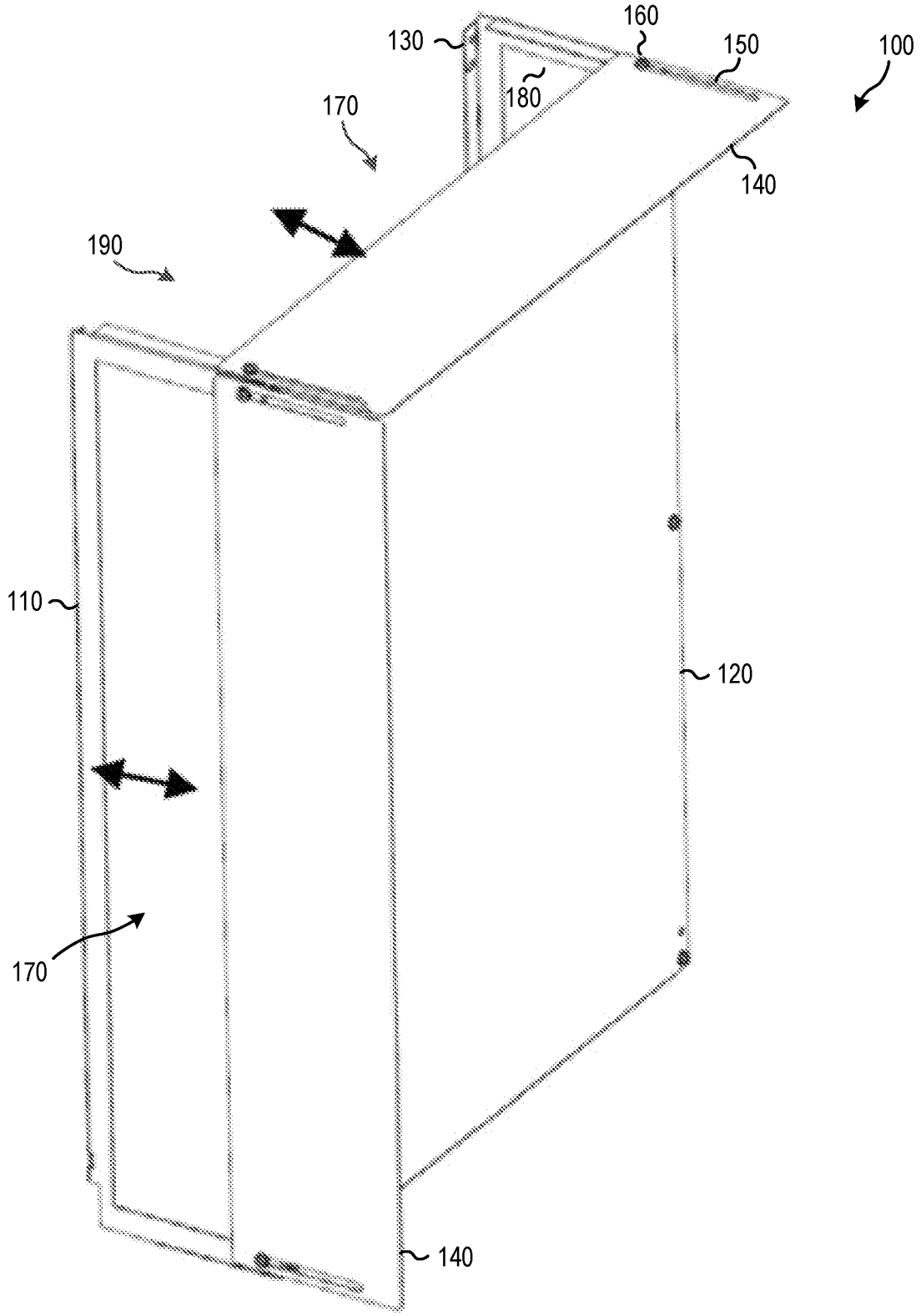
FIG. 1 is a diagram of a wind baffle using variable block-off plates as variable air vents according to disclosed embodiments.

FIG. 1 is a diagram of a wind baffle 100 using variable block-off plates as variable air vents 140 according to disclosed embodiments. As shown in FIG. 1, the wind baffle 100 includes a frame 110, a back plate 120, one or more securing mechanisms 130, a plurality of variable air vents 140, a plurality of positioners 150, a plurality of fasteners 160, a plurality of openings 170, one or more stationary walls 180, and a vent opening 190.

The frame 110 is a structure that supports the remaining elements of the wind baffle 100. It defines a hollow area between the back plate 120, the plurality of openings 170, the one or more stationary walls 180, and the vent opening 190. In the disclosed embodiment, the frame 110 can be a series of connected struts that either include each element or provide a structure for the elements to be connected.

The back plate 120 is a solid wall structure connected to the frame 110 and formed opposite the vent opening 190. The back plate 120 operates to block wind from passing in the direction it covers.

Although the back plate 120 is shown as being a flat surface, this is by way of example only. In alternate embodiments, the back plate 120 could have a different shape. For example, it could be curved, dome-like, etc., So long as it blocks air from passing through.

The one or more securing mechanisms 130 are formed on the frame 110 and are arranged such that they can secure the frame 110 to an outdoor air-conditioning unit adjacent to an air intake on the outdoor air-conditioning unit. In the embodiment of FIG. 1, the securing mechanisms 130 are nuts and bolts. However, this is by way of example only. Any mechanism for securing the frame 110 to an outdoor air-conditioning unit can be used as a securing mechanism 130. For example, in some alternate embodiments the securing mechanisms 130 could be screws, clamps, etc.

The plurality of variable air vents 140 are formed on at least two sides of the wind baffle 100 and can be arranged in a plurality of positions that each allow a different amount of air to pass through. These positions include a fully-closed position in which a variable air vent 140 completely obscures a corresponding opening 170 and at least one open position in which the variable air vent 140 leaves at least a portion of the corresponding opening 170 open and able to pass air.

In some embodiments the variable air vents 140 will have multiple possible open positions including a fully-open position in which the variable air vent 140 leaves the entirety of the corresponding opening open, and one or more partially-open positions in which the variable air vent 140 leaves a fraction of the corresponding opening 170 open.

In the embodiment of FIG. 1, the variable air vents 140 are variable block-off plates that are flat plates that can completely obscure a corresponding opening 170, and can be slid to the side such that they only partially obscure the corresponding opening 170, or don't obscure the corresponding opening 170 at all.

In the embodiment of FIG. 1, the each of the variable air vents 140 includes a positioner 150 on opposite sides and a fastener 160 associated with each positioner 150 that can pass through a corresponding positioner 150 and secure the corresponding variable air vent 140 to the frame 110.

The plurality of positioners 150 in the embodiment of FIG. 1 are each a linear opening cut in one side of a corresponding variable air vent 140.

The plurality of fasteners 160 are bolts that slide through a corresponding positioner 150 and into a hole (not shown) in the frame 110 and are secured by a corresponding nut.

The plurality of openings 170 are empty spaces in the frame 110 that can be covered over, in whole or in part, by the corresponding variable air vents 140. When at least a portion of an opening 170 is left unobscured by a corresponding variable air vent 140, air can pass from outside the wind baffle 100 into the hollow portion of the wind baffle 100 through the opening 170. The amount of air that can pass into the hollow portion, and the speed at which the air will pass into the hollow portion will depend upon how much of the opening 170 is left unobscured by the corresponding variable air vent 140.

The one or more stationary walls 180 are structures on one or more sides of the frame 110 that operate to prevent wind from entering into the hollow space between the back plate 120 and the vent opening 190 in the direction it covers.

The vent opening 190 is an empty space in the frame 110 opposite the back plate 120. The wind baffle 100 is configured such that air in the hollow portion of the wind baffle 100 can freely pass through the vent opening 190.

In operation, the frame 110 can be secured to an outdoor air-conditioning unit such that the one or more securing mechanisms 130 are connected to corresponding connection portions on an outdoor air-conditioning unit. In such an arrangement, the vent opening 190 will be formed adjacent to an air intake of the outdoor air-conditioning unit. In this way, air that flows into the hollow portion of the wind baffle 100 can freely pass into the air intake of the outdoor air-conditioning unit through the vent opening 190.

Once the frame 110 is secured to the outdoor air-conditioning unit, the back plate 120 will prevent air from blowing directly onto the air intake of the outdoor air-conditioning unit. Similarly, each of the one or more stationary walls 180 will prevent air from passing into the hollow area portion of the wind baffle 100 in a corresponding direction.

Each of the variable air vents 140 of FIG. 1 can be moved to one of a plurality of positions by loosening the fasteners 160 on either side and sliding the variable air vent 140 perpendicular to the back plate 120 via the positioners 150 such that a fraction of a corresponding opening 170 from 0% to 100% is left open. Once the variable air vent 140 is secured into a proper position, corresponding fasteners 160 passing through the positioners 150 will be tightened such that they press the variable block-off plate 140 against the frame 110 in such a way that the variable block-off plate 140 cannot move. In this way, the variable air vent 140 can be secured in a position such that the desired portion of the corresponding opening 170 is left open and able to pass air.

An operator can arrange each of the plurality of variable air vents 140 on the wind baffle 100 such that they allow a desired amount of air in through the corresponding opening 170. In this way, the particular configuration of the wind baffle 100 can be altered before or after installation to account for the prevailing wind conditions around the outdoor air-conditioning unit. Each configuration can allow different amounts of wind to enter the hollow portion of the wind baffle 100 from different directions. The same wind baffle design can thus be used for outdoor air-conditioning units in different conditions (e.g., different prevailing wind directions and intensities). By properly configuring the variable air vents 140, each individual wind baffle 100 can optimize the incoming air to avoid excess wind blowing on the air intake of the outdoor air-conditioning unit.

Although FIG. 1 discloses that at least one side of the wind baffle 100 is a stationary wall 180, this is by way of example only. Some embodiments could have every wall of the wind baffle 100 be formed of a variable air vent 140.

In some embodiments the wind baffle 100 can be configured such that it can only be secured to an outdoor air-conditioning unit in one orientation. However, alternate embodiments can provide a wind baffle 100 that can be secured to an outdoor air-conditioning unit in multiple orientations. For example, a wind baffle 100 could be provided with variable air vents 140 on two adjacent sides, and stationary walls 180 on two other adjacent sides. The wind baffle 100 could then be configured such that it could be connected to the outdoor air-conditioning unit in two different configurations. The first configuration could be with variable air vents 140 facing up and to the left and stationary walls 180 facing down and to the right. The second configuration could involve rotating the wind baffle 100 180° such that the variable air vents 140 faced down into the right and the stationary walls 180 faced up and to the left. This design would allow a greater variety of configurations for the wind baffle 100, while simplifying its design. Other embodiments could provide for other possible orientations for the wind baffle 100.

As shown in FIG. 1, the positioners 150 in the disclosed embodiment are open, linear holes that allow the associated variable air vent 140 to move to any position from fully open to fully closed. Alternate embodiments could employ a different kind of positioner 150. For example, the positioner could include a plurality of individual bolt holes that would allow the fastener 160 to secure the associated air vent 140 in one of a plurality of fixed positions. In one embodiment there could be five bolt holes representing five fixed positions: fully closed, 25% open, 50% open, 75% open, and fully open. Other embodiments could provide more or fewer bolt holes representing more or fewer fixed positions. In such an embodiment a user could change the position of a variable air vent 140 by removing the two fasteners 160 associated with a given variable air vent 140, moving the variable air vent 140 to a new position, and then securing the variable air vent 140 in the new position using the corresponding fastener 160.

Although in the disclosed embodiment of FIG. 1, the fasteners 160 are disclosed as being bolts, this is by way of example only. Other mechanisms for securing the variable air vents 140 can be used in alternate embodiments. For example, in some embodiments the fasteners 160 could be screws, clamps, etc.

In various embodiments the frame 110, the back plate 120, the plurality of variable air vents 140, and the one or more stationary walls 180 may be made of metal, plastic, or any other suitable material.

Although FIG. 1 discloses that the wind baffle 100 is rectangular in shape, this is by way of example only. Alternate embodiments can alter the shape of the wind baffle 100, provided it retains a back plate 120 and a plurality of variable air vents 140 on different sides of the wind baffle 100. For example, one embodiment could use a hexagonal wind baffle having six sides, at least two of which were variable air vents 140, and the remainder of which were either variable air vents 140 or stationary walls 180. Likewise, another embodiment could use a wind baffle having a cylindrical shape in which a plurality of variable air vents 140 were formed as arcs along the circumference of the cylinder. Other shapes and configurations are possible in other embodiments.

Alternate Embodiments

FIG. 1 discloses a wind baffle 100 that can allow a variable amount of air through a plurality of openings 170 through the use of a plurality of variable block-off plates operating as the variable air vents 140. These flat plates block air from passing through a corresponding opening 170 or allow air to pass through a corresponding opening 170 by being moved such that they cover some or all of the corresponding opening 170. However, alternate embodiments could employ different variable air vents 140 that can vary the amount of air that passes through a corresponding opening 170 in different ways.

One embodiment could replace the block-off plates with a set of louvers that obscure a corresponding opening 170. These louvers would include a plurality of parallel slots that could be rotated between a fully closed position and a fully open position, with one or more partially open positions potentially in between the fully open position and the fully closed position. The amount of air that could pass through the opening 170 will vary depending upon the degree to which the louvers were open or closed.

Another embodiment could replace the block-off plates with one or more removable strips that obscure the opening 170. If none of the removable strips were removed, the variable air vent 140 would prevent any air from passing through in that direction. If all of the removable strips were removed, the variable air vent 140 would freely allow air to pass through a corresponding opening 170. If fewer than all of the strips were removed, the variable air vent 140 would partially restrict air passing through the opening 170.

In various embodiments, these strips could be permanently removable or removed in such a manner that they could be replaced. For example, in one embodiment the strips in each variable air vent 140 could be configured such that a user could use a tool to permanently break a strip out of the variable air vent 140 (e.g., during installation). Each strip could be connected to the frame 110 by a thin strip of plastic or metal that could easily be cut or otherwise broken. Once removed, each strip would be permanently removed and could not be replaced. In another embodiment, each strip could be secured by a securing mechanism (e.g., a plurality of nuts and bolts, screws, clamps, etc.) that would allow them to be removed and then later replaced. In this way, the wind baffle 100 could be reconfigured at different times such that each variable air vent 140 could potentially pass a different amount of air.

Air-Conditioning System Using Variable Wind Baffles

Figure 2:
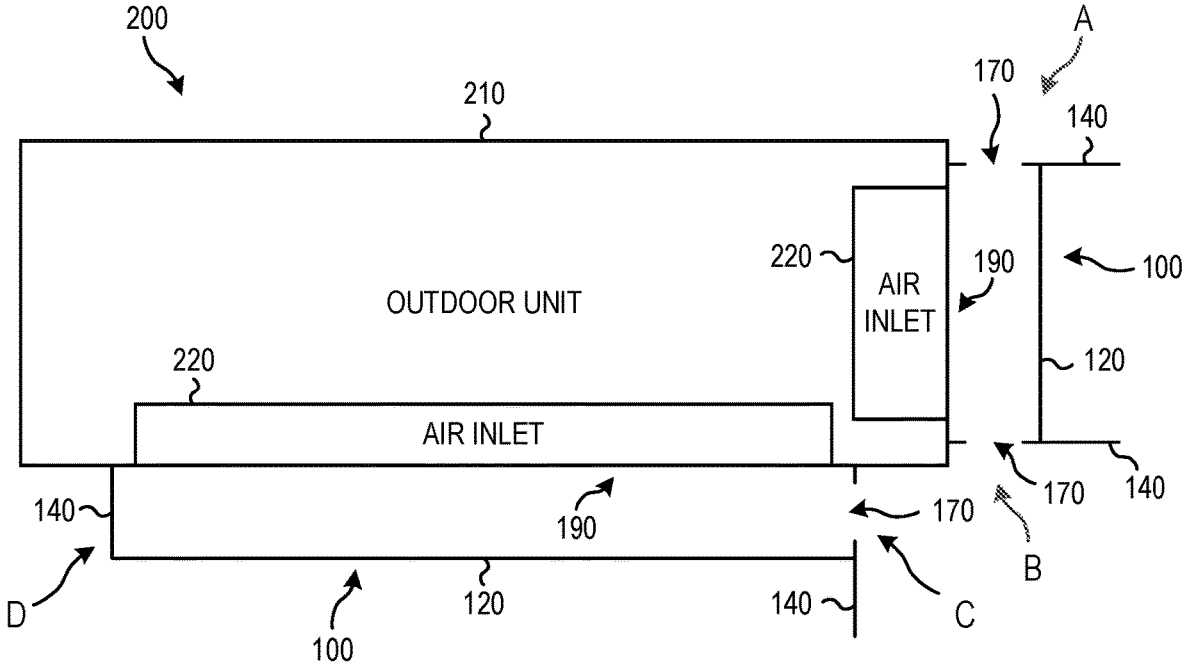
FIG. 2 is a diagram of an air-conditioning system including the wind baffle of FIG. 1 according to disclosed embodiments.

FIG. 2 is a diagram of an air-conditioning system 200 including the wind baffle 100 of FIG. 1 according to disclosed embodiments. As shown in FIG. 2, the air-conditioning system 200 includes an outdoor unit 210 having two air inlets 220 on different sides of the outdoor unit 210. A wind baffle 100 is attached adjacent to each air inlet 220. For ease of description the wind baffle 100 at the bottom of the drawing will be referred to as the bottom wind baffle 100 and the wind baffle 100 at the right of the drawing will be referred to as the right wind baffle 100.

The outdoor unit 210 is an outdoor air-conditioning unit that draws outdoor air in through the air inlets 220, passes the outdoor air over a refrigerant coil, exchanges heat between the outdoor air and the refrigerant coil, and then ejects the outdoor air through an air outlet (not shown).

Each wind baffle 100 is secured to the outdoor unit 210 by one or more securing mechanisms 130 (not shown in FIG. 2) such that the vent opening 190 of each wind baffle 100 directly faces a corresponding air inlet 220, and a corresponding back plate 120 is arranged opposite the vent opening 190 such that the back plate 120 prevents air from passing from the side having the back plate 120 into the hollow area within the wind baffle 100, and thereby through the vent opening 190 and into the air inlet 220. The only way for air to pass into the hollow area within the wind baffle 100 and through the vent opening 190 into the air inlets 220 is by passing through one or more of the openings 170.

As shown in FIG. 2, this disclosed embodiment employs variable block-off plates for the variable air vents 140. This is by way of example only. Other embodiments could use different mechanisms for the variable air vents 140.

Two walls of each wind baffle 100 are shown in the embodiment of FIG. 2. This, is by way of example only. Each wind baffle 100 would include at least one other wall that could be a stationary wall 180 or a variable air vent 140. For the sake of simplicity of description, it will be assumed that each of the wind baffles 100 includes four walls, the two opposite walls that are shown being configured as variable air vents 140 and the two opposite walls that are not shown being configured as stationary walls 180. However, this is by way of example only. Alternate embodiments could vary which walls were configured as variable air vents 140 and which walls were configured as stationary walls 180 or could vary the number of variable air vents 140 used.

In the embodiment of FIG. 2, the bottom wind baffle 100 has a variable air vent 140 on the left of the drawing that is completely closed and a variable air vent 140 on the right of the drawing that is at least partially opened. In this configuration, air could only enter into the bottom wind baffle 100 from the opening 170 on the right side of the drawing, which is configured to be at least partially open. Similarly, the right wind baffle 100 has both the variable air vent 140 on the top of the drawing and the variable air vent 140 on the bottom of the drawing configured to be at least partially open. In this configuration, air could enter into the right wind baffle 100 from either of the openings 170 on the top or the bottom, since those openings 170 are both at least partially open.

One reason for configuring the variable air vents 140 differently on the wind baffles 100 connected to each air inlet 220 is to arrange the wind baffles 100 such that they minimize the amount of wind that blows onto the air inlets 220 during cold weather, since high winds blowing on air inlets 220 during cold weather can reduce the efficiency of the outdoor unit 210.

The particular configurations of the variable air vents 140 on the bottom and right wind baffles 100 can be set based on knowledge of the prevailing winds surrounding the outdoor unit 210. Information on the prevailing winds can come from wind sensors, weather reports, or any other suitable information source.

Figure 3A:
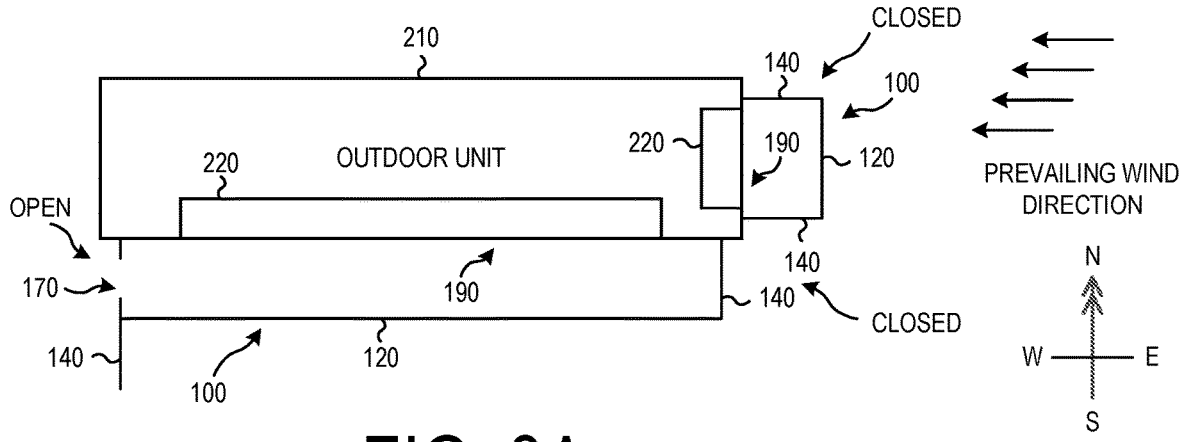
FIGS. 3A-3H are diagrams showing various configurations of the air-conditioning system of FIG. 2 according to disclosed embodiments.
Figure 3B:
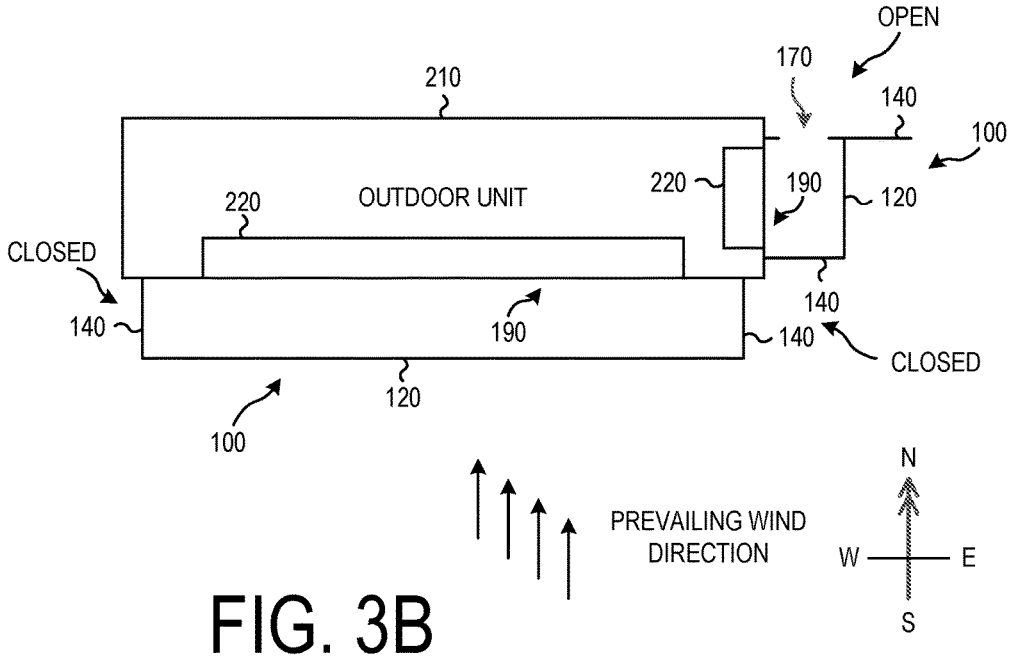
Figure 3C:
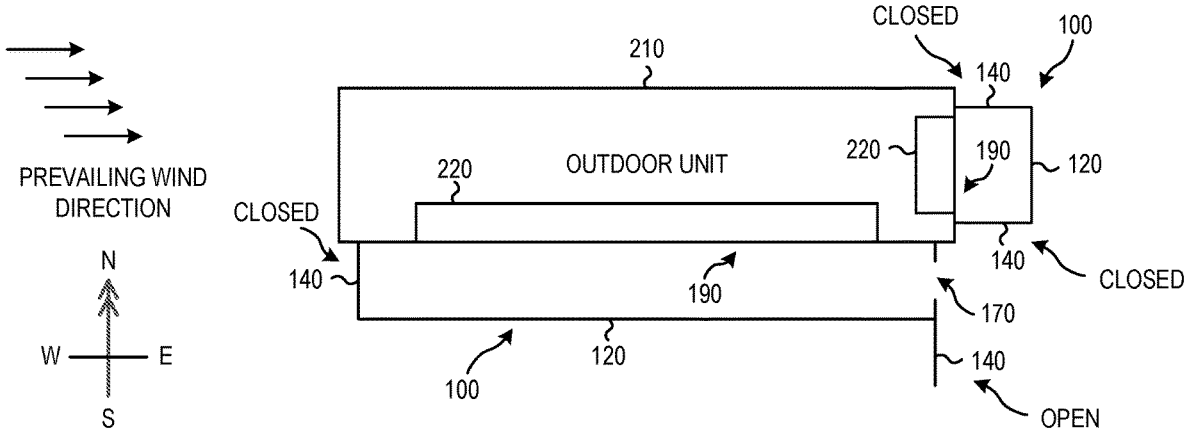
Figure 3D:
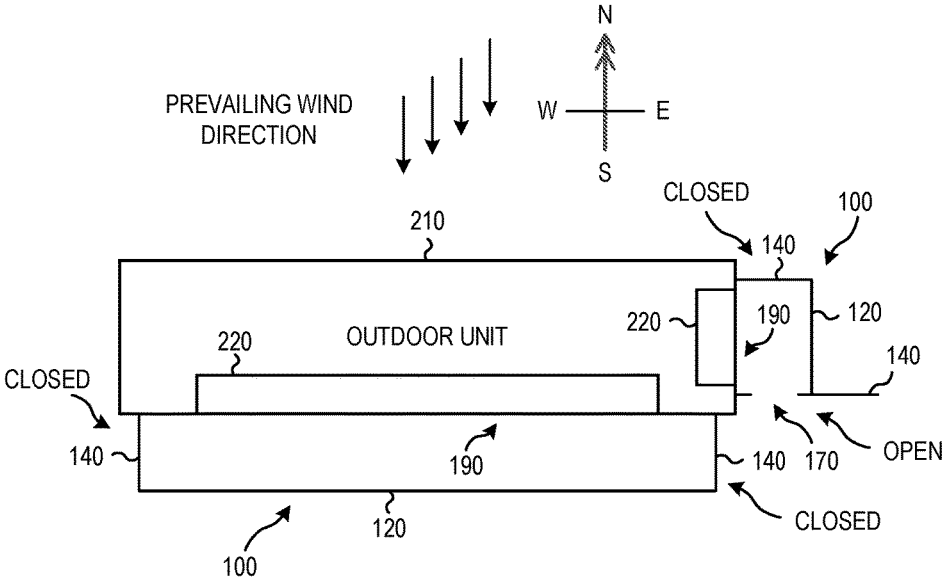
Figure 3E:
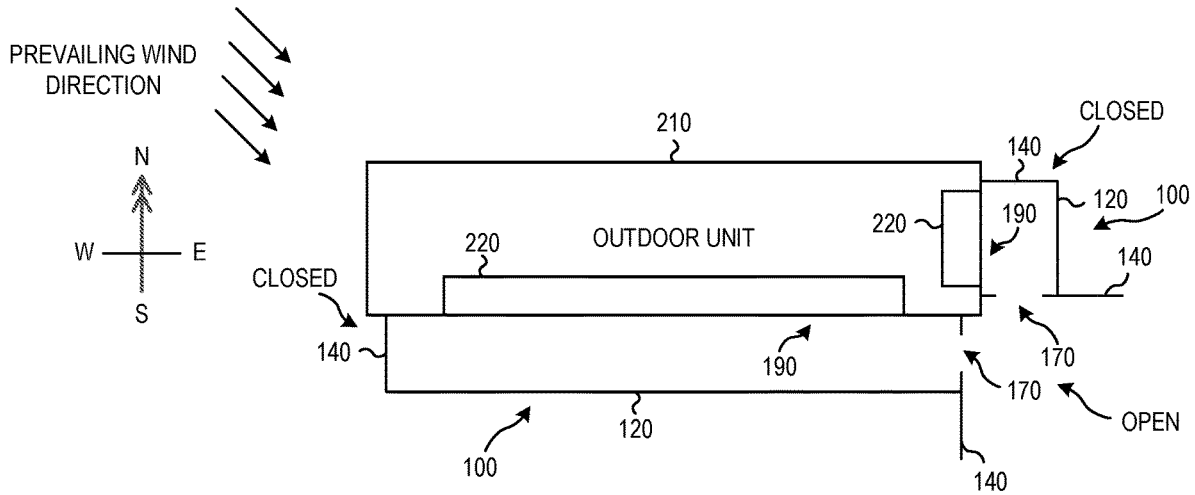
Figure 3F:
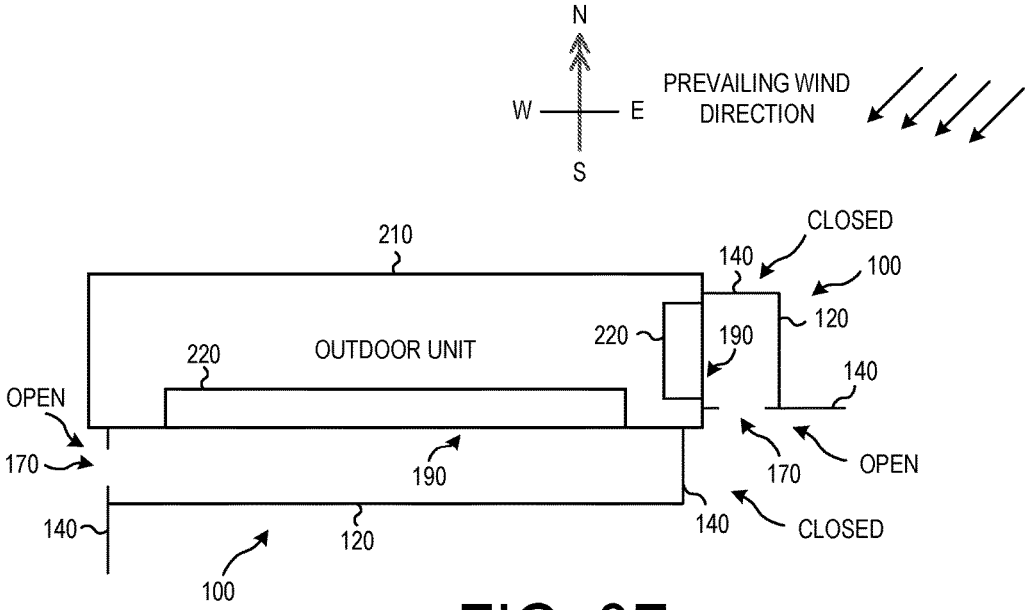
Figure 3G:
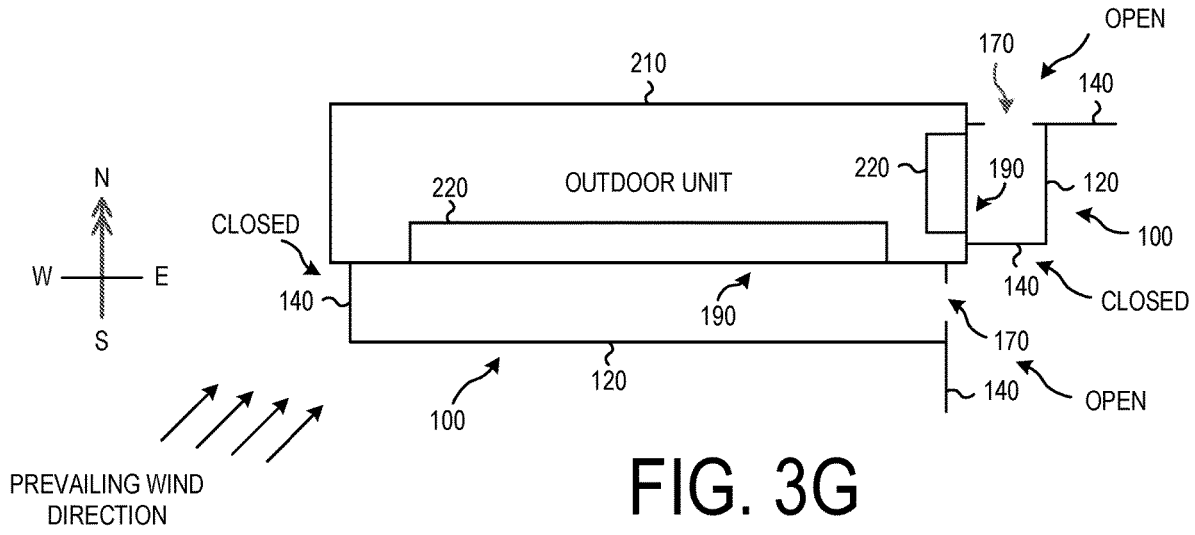
Figure 3H:
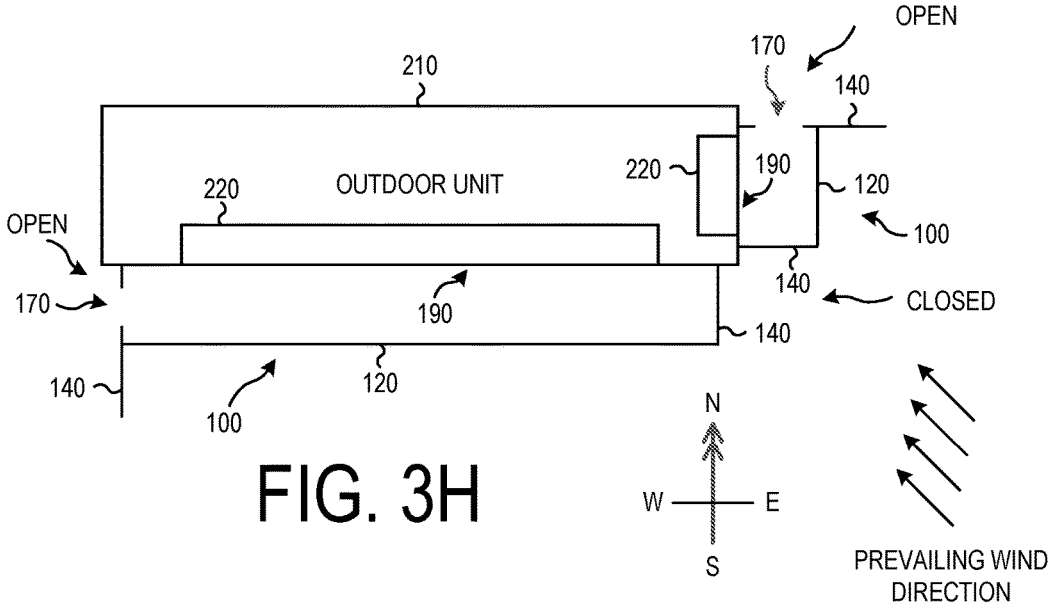

FIGS. 3A-3H are diagrams showing various configurations of the air-conditioning system 200 of FIG. 2 according to disclosed embodiments. FIGS. 3A-3H show eight examples of the prevailing wind. FIG. 3A shows a configuration in which the prevailing wind is from the east; FIG. 3B shows a configuration in which the prevailing wind is from the south; FIG. 3C shows a configuration in which the prevailing wind is from the west; FIG. 3D shows a configuration in which the prevailing wind is from the north; FIG. 3E shows a configuration in which the prevailing wind is from the northwest; FIG. 3F shows a configuration in which the prevailing wind is from the northeast; FIG. 3G shows a configuration in which the prevailing wind is from the southwest; FIG. 3H shows a configuration in which the prevailing wind is from the southeast. As shown in FIGS. 3A-3H, the various air vents 140 can each be configured differently based on the prevailing winds surrounding the outdoor unit 210.

In the embodiment of FIG. 3A in which the prevailing wind is from the east, only the left variable air vent 140 on the bottom wind baffle 100 is at least partially open. If the right variable air vent 140 on the bottom wind baffle 100 was even partially open, an undesirable amount of wind could blow through the exposed opening 170 and into the corresponding air inlet 220. Likewise, if the top or bottom variable air vents 140 on the right wind baffle 100 were partially opened, an undesirable amount of wind could blow through the exposed openings 170 onto the corresponding air inlet 220.

In the embodiment of FIG. 3B in which the prevailing wind is from the south, only the top variable air vent 140 on the right wind baffle 100 is at least partially open. If the bottom variable air vent 140 on the right wind baffle 100 was even partially open, an undesirable amount of wind could blow through the exposed opening 170 and into the corresponding air inlet 220. Likewise, if the left or right variable air vents 140 on the bottom wind baffle 100 were partially opened, an undesirable amount of wind could blow through the exposed openings 170 onto the corresponding air inlet 220.

In the embodiment of FIG. 3C in which the prevailing wind is from the west, only the right variable air vent 140 on the bottom wind baffle 100 is at least partially open. If the left variable air vent 140 on the bottom wind baffle 100 was even partially open, an undesirable amount of wind could blow through the exposed opening 170 and into the corresponding air inlet 220. Likewise, if the top or bottom variable air vents 140 on the right wind baffle 100 were partially opened, an undesirable amount of wind could blow through the exposed openings 170 onto the corresponding air inlet 220.

In the embodiment of FIG. 3D in which the prevailing wind is from the north, only the bottom variable air vent 140 on the right wind baffle 100 is at least partially open. If the top variable air vent 140 on the right wind baffle 100 was even partially open, an undesirable amount of wind could blow through the exposed opening 170 and into the corresponding air inlet 220. Likewise, if the left or right variable air vents 140 on the bottom wind baffle 100 were partially opened, an undesirable amount of wind could blow through the exposed openings 170 onto the corresponding air inlet 220.

In the embodiment of FIG. 3E in which the prevailing wind is from the northwest, the right variable air vent 140 on the bottom wind baffle 100 and the bottom variable air vent 140 on the right wind baffle 100 are at least partially open. If the left variable air vent 140 on the bottom wind baffle 100 or the upper variable air vent on the right wind baffle 100 were even partially open, an undesirable amount of wind could blow through the exposed opening 170 and into a corresponding air inlet 220.

In the embodiment of FIG. 3F in which the prevailing wind is from the northeast, the left variable air vent 140 on the bottom wind baffle 100 and the bottom variable air vent 140 on the right wind baffle 100 are at least partially open. If the right variable air vent 140 on the bottom wind baffle 100 or the top variable air vent 140 on the right wind baffle 100 were even partially open, an undesirable amount of wind could blow through the exposed opening 170 and into a corresponding air inlet 220.

In the embodiment of FIG. 3G in which the prevailing wind is from the southwest, the right variable air vent 140 on the bottom wind baffle 100 and the top variable air vent 140 on the right wind baffle 100 are at least partially open. If the left variable air vent 140 on the bottom wind baffle 100 or the bottom variable air vent on the right wind baffle 100 were even partially open, an undesirable amount of wind could blow through the exposed opening 170 and into a corresponding air inlet 220.

In the embodiment of FIG. 3H in which the prevailing wind is from the southeast, the left variable air vent 140 on the bottom wind baffle 100 and the top variable air vent 140 on the right wind baffle 100 are at least partially open. If the right variable air vent 140 on the bottom wind baffle 100 or the bottom variable air vent on the right wind baffle 100 were even partially open, an undesirable amount of wind could blow through the exposed opening 170 and into a corresponding air inlet 220.

These eight disclosed embodiments are by way of example only. The prevailing winds could come from any direction, and the variable air vents 140 in the various wind baffles 100 could be arranged in different configurations. For example, FIGS. 3A-3H do not identify the degree of openness of each of the open variable air vents 140. Different prevailing winds could warrant some variable air vents 140 being completely closed, some variable air vents 140 being partially open and some variable air vents 140 being completely open. The particular configuration of variable air vents 140 will depend upon the precise details of the prevailing winds. Any desirable configuration is possible.

Alternate Embodiments

Figure 4:
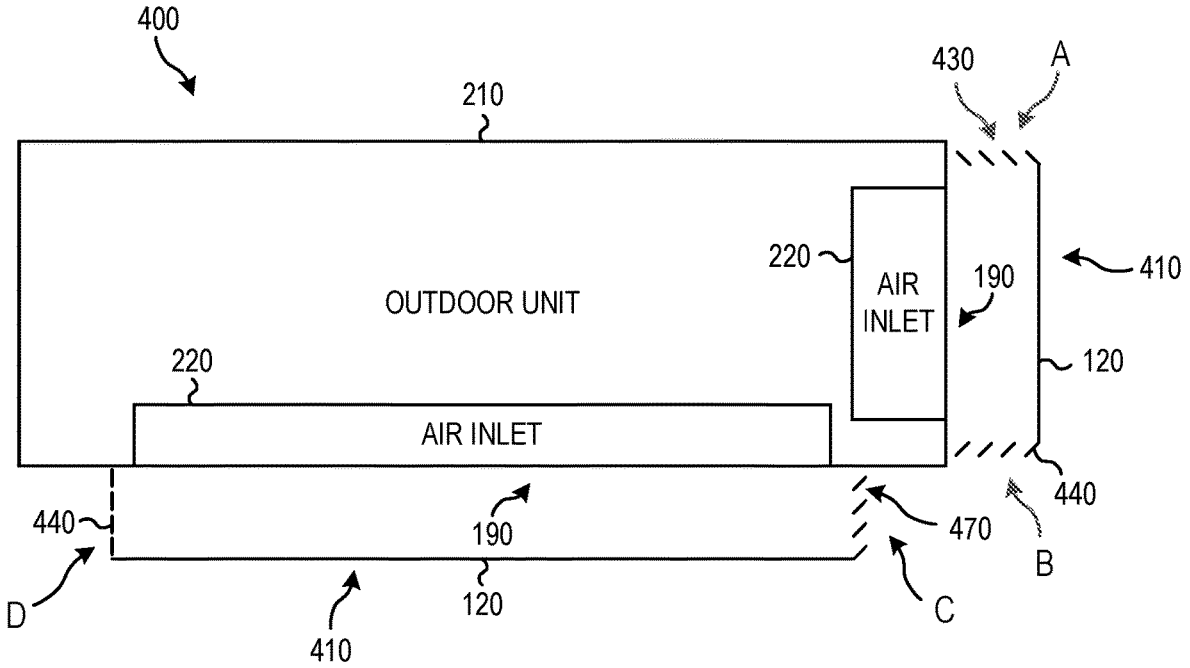
FIG. 4 is a block diagram of an air-conditioning system using a wind baffle using louvers as variable air vents according to disclosed embodiments.

As noted above, different embodiments can employ different configurations for the variable air vents 140. FIGS. 4-6 disclose embodiments that employ different kinds of variable air vents 140 from those used in FIGS. 1-3H.

FIG. 4 is a block diagram of an air-conditioning system 400 using a wind baffle 410 having louvers as variable air vents 440 according to disclosed embodiments.

As shown in FIG. 4, the air-conditioning system 400 includes an outdoor unit 210 having two air inlets 220 on different sides of the outdoor unit 210. A wind baffle 410 is attached adjacent to each air inlet 220. For ease of description the wind baffle 410 at the bottom of the drawing will be referred to as the bottom wind baffle 410 and the wind baffle 410 at the right of the drawing will be referred to as the right wind baffle 410.

Each wind baffle 410 includes a back plate 120, two or more louvers serving as variable air vents 440, two or more openings 470 covered by the variable air vents 440, and a vent opening 190. Although not shown in FIG. 4, each wind baffle 410 will also include a frame 110 and one or more securing mechanisms 130, which are configured as described above with respect to FIG. 1 and serve comparable purposes.

The outdoor unit 210 and its two air inlets 220 operate as described above with respect to FIG. 2. The back plate 120 and the vent opening 190 operate as described above with respect to FIG. 1.

The two or more variable air vents 440 are louvers that are arranged covering comparable openings 470 and are configured such that each variable air vent 440 contains a plurality of slats attached in parallel at regular intervals in the associated opening 470. The plurality of slats can be each be swiveled along a corresponding axis such that they can be arranged to be parallel to the plane of the opening 470, perpendicular to the plane of the opening 470, or an angle between parallel and perpendicular to the plane of the opening 470.

The openings 470 are comparable to the openings 170 in the wind baffle 100 of FIG. 1. They provide passage for outdoor air from outside the wind baffle 410 into the hollow space within the wind baffle 410 and thereby through the vent opening 190 to a corresponding air inlet 220.

When the slats in a variable air vent 440 are parallel to the plane of an associated opening 470, they completely close the opening 470 preventing any air from passing through the opening 470. When the slats are perpendicular to the plane of the opening 470, air freely flows through the opening 470. When the slats are at an angle between parallel and perpendicular to the plane of the opening 470, air can pass through the opening 470, but is restricted based on the degree to which the slats are opened. By controlling the angle of the slats in each louver 440, a user can control the amount of air that passes through a given opening 470.

The embodiment of FIG. 4 has the same configuration of opening and closing of the variable air vents 440 as the embodiment of FIG. 1 has for the opening and closing of the variable air vents 140. Specifically, in the bottom wind baffle 410, the left variable air vent 440 is entirely closed, while the right air vent 440 is at least partially open. Likewise, in the right wind baffle 410, both the top and bottom variable air vents 440 are at least partially open. Again, this is by way of example only. Different embodiments can open or close different variable air vents 440 as desired to achieve a desired configuration for airflow based on prevailing wind conditions near the outdoor unit 210.

Figure 5A:
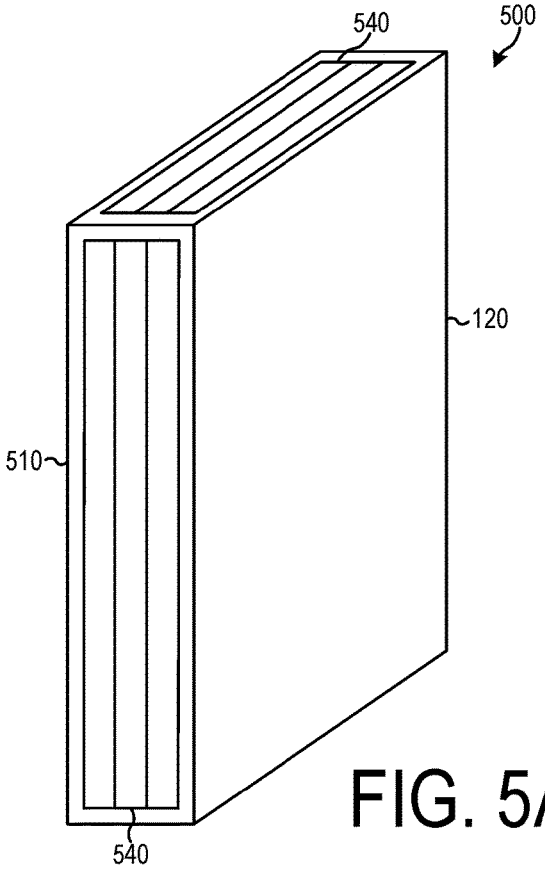
FIGS. 5A and 5B are diagrams of a wind baffle using slats as variable air vents according to disclosed embodiments.
Figure 5B:
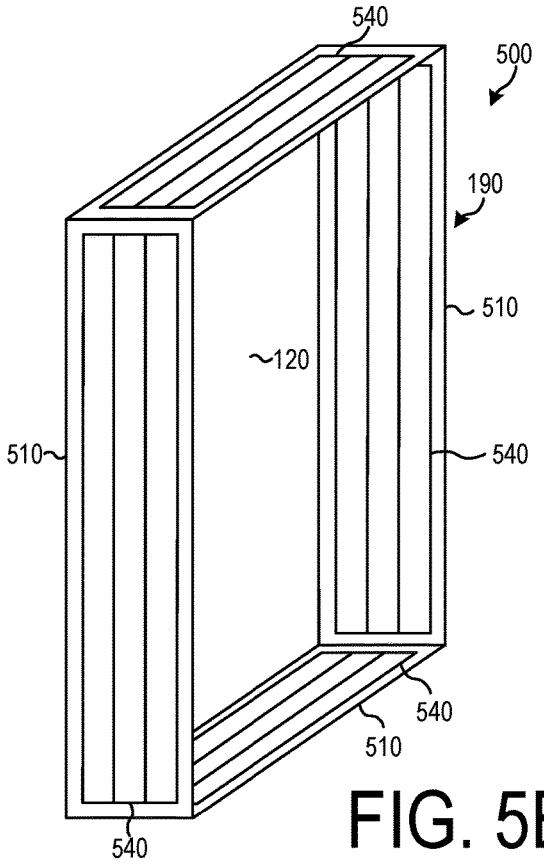
Figure 6:
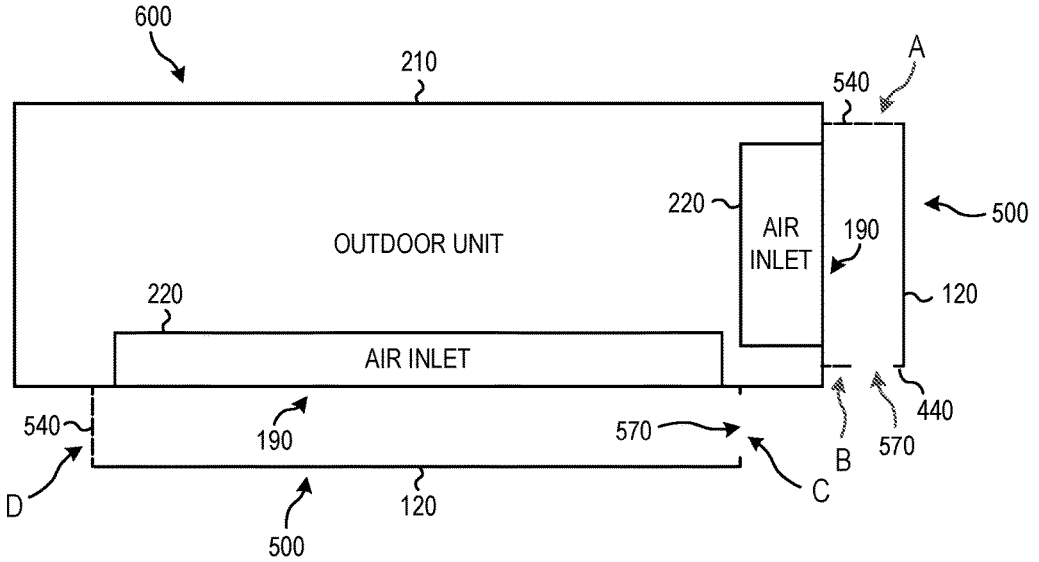
FIG. 6 is a block diagram of an air-conditioning system using the wind baffle of FIG. 5 according to disclosed embodiments.

FIGS. 5A and 5B are diagrams of a wind baffle 500 using slats as variable air vents 540 according to disclosed embodiments. As shown in FIGS. 5A and 5B, the wind baffle 500 includes a frame 510, a back plate 120, a plurality of variable air vents 540, and a vent opening 190.

The back plate 120 and the vent opening 190 operate as described above with respect to FIG. 1.

The frame 510 is a structure that supports the remaining elements of the wind baffle 500. It defines a hollow area between the back plate 120, the variable air vents 540, and the vent opening 190. In the disclosed embodiment, the frame can be a series of connected struts that either include each element or provide a structure for the elements to be connected The plurality of variable air vents 540 are formed on at least two sides of the wind baffle 500. The specific embodiment of FIG. 5 includes variable air vents 540 on all four sides of the wind baffle 500. However, this is by way of example only. Alternate embodiments could include variable air vents 540 on fewer than all sides of the wind baffle 500. Such alternate embodiments can replace one or more of the variable air vents 140 with one or more stationary walls 180 as shown above with respect to FIG. 1.

The variable air vents 540 are arranged as a plurality of slats that cover openings 570 on the sides of the wind baffle 500. In the embodiment of FIGS. 5A and 5B three slats are shown. However, this is by way of example only. Alternate embodiments could use more or fewer slats in each variable air vent 540. Some embodiments could even use different numbers of slats in different variable air vents 540 in the same wind baffle 500.

No openings 570 are shown in FIG. 5A or 5B since the variable air vents 540 in these drawings have all of the slats in place. When the wind baffle 500 is attached to an outdoor air-conditioning unit, one or more of the slats on one or more of the variable air vents 540 can be removed to allow air to flow through opening 570 in the wind baffle 500. As noted above with respect to other embodiments, the particular configuration of how each variable air vents 540 is arranged will vary depending upon the placement of the outdoor air-conditioning unit and the prevailing winds surrounding the outdoor air-conditioning unit.

In some embodiments, the slats in the variable air vents 540 are configured such that they can be removed and later replaced. For example, each slat could snap into place, or could be secured by screws or nuts and bolts. In other embodiments, the slats in the variable air vents 540 are configured such that once they are removed, they cannot be replaced. For example, each slat could be connected to the frame 540 by a thin piece of metal or plastic. An operator could remove a given slat by breaking the thin piece of metal or plastic freeing the slat. However, once the thin piece of metal or plastic was broken, it could not be repaired. Such variable air vents 540 could be configured once, but would have to retain that configuration evermore.

The variable air vents 540 will have multiple possible open positions based on how many of the slats are removed. In this embodiment, a fully-open position of the variable air vent 540 corresponds to a configuration in which all of the slats covering a given opening 570 are removed; a partially-open position corresponds to a configuration in which some, but not all, of the slats covering a given opening 570 are removed; and a fully-closed position corresponds to a configuration in which none of the slats covering a given opening 570 are removed.

Although not specifically shown in FIGS. 5A and 5B, the plurality of openings 570 are empty spaces in the frame 510 that can be covered over, in whole or in part, by the corresponding variable air vents 540. When at least a portion of an opening 570 is left unobscured by a corresponding variable air vent 540, air can pass from outside the wind baffle 500 into the hollow portion of the wind baffle 500 through the opening 570. The amount of air that can pass into the hollow portion, and the speed at which the air will pass into the hollow portion will depend upon how much of the opening 570 is left unobscured by the corresponding variable air vent 540.

Although not shown in FIGS. 5A and 5B, the wind baffle 500 may replace one or more of the variable air vents 540 with one or more stationary walls 180 as shown above with respect to FIG. 1.

Although not shown in FIGS. 5A and 5B, the wind baffle 500 may include one or more securing mechanisms 130 formed on the frame 510 and arranged such that they can secure the frame 510 to an outdoor air-conditioning unit adjacent to an air intake on the outdoor air-conditioning unit.

FIG. 6 is a block diagram of an air-conditioning system 600 using the wind baffle 500 of FIG. 5 according to disclosed embodiments.

As shown in FIG. 6, the air-conditioning system 600 includes an outdoor unit 210 having two air inlets 220 on different sides of the outdoor unit 210. A wind baffle 500 is attached adjacent to each air inlet 220. For ease of description the wind baffle 500 at the bottom of the drawing will be referred to as the bottom wind baffle 500 and the wind baffle 500 at the right of the drawing will be referred to as the right wind baffle 500.

Each wind baffle 500 includes a back plate 120, two or more variable air vents 540 on different sides, two or more openings 570 covered by the variable air vents 540, and a vent opening 190. Although not shown in FIG. 6, each wind baffle 500 will also include a frame 510 and one or more securing mechanisms 130, which are configured as described above with respect to FIGS. 1, 5A and 5B and serve comparable purposes.

The outdoor unit 210 and its two air inlets 220 operate as described above with respect to FIG. 2. The back plate 120 and the vent opening 190 operate as described above with respect to FIG. 1.

The two or more variable air vents 540 are configured as a plurality of slats formed side-by-side and covering corresponding openings 570. Each variable air vent 540 is further configured such that one or more of the slats that form the variable air vent 540 can be removed to allow air to flow through the corresponding opening 570. The amount of air that will flow through an opening 570 will depend on the number of slats that are provided and the number of slats that are removed. The more slats that are removed, the more air will flow through the corresponding opening 570.

The openings 570 are comparable to the openings 170 in the wind baffle 100 of FIG. 1 they provide passage from outside the wind baffle 500 into the hollow space within the wind baffle 500 and thereby through the vent opening 190 to a corresponding air inlet 220.

When none of the slats in a variable air vent 540 removed, the variable air vent 540 completely closes the opening 570, preventing any air from passing through the opening 470. When all of the slats in a variable air vent 540 are removed, the variable air vent 540 fully opens the opening 570, allowing air to freely flow through the opening 570. When some, but not all, of the slats in a variable air vent 540 are removed, the opening 570 is partially opened, allowing some air to pass through the opening 470, but not as much as if the opening 570 were fully open. By controlling number of slats removed in each variable air vent 540, a user can control the amount of air that passes through a corresponding opening 570.

In the embodiment of FIG. 6 the bottom wind baffle 500 has the left variable air vent 540 entirely closed and the right air vent 540 fully open. Similarly, the right wind baffle 410 has a top variable air vent 540 entirely closed and a bottom variable air vents 440 partially open (two out of three slats are removed). Again, this is by way of example only, and different embodiments can open or close different variable air vents 540 as desired to achieve a desired configuration for airflow. These variable air vents 540 can each be opened to a desired degree.

In addition, although all of the above disclosed embodiments use the same mechanism for the variable air vents 140, 440, 540 in a given wind baffle 100, 410, 500, this is by way of example only. Alternate embodiments could employ different types of variable air vents 140, 440, 540 on the same wind baffle 100, 410, 500.

Outdoor Air-Conditioning Units with More Air Inlets

Figure 7:
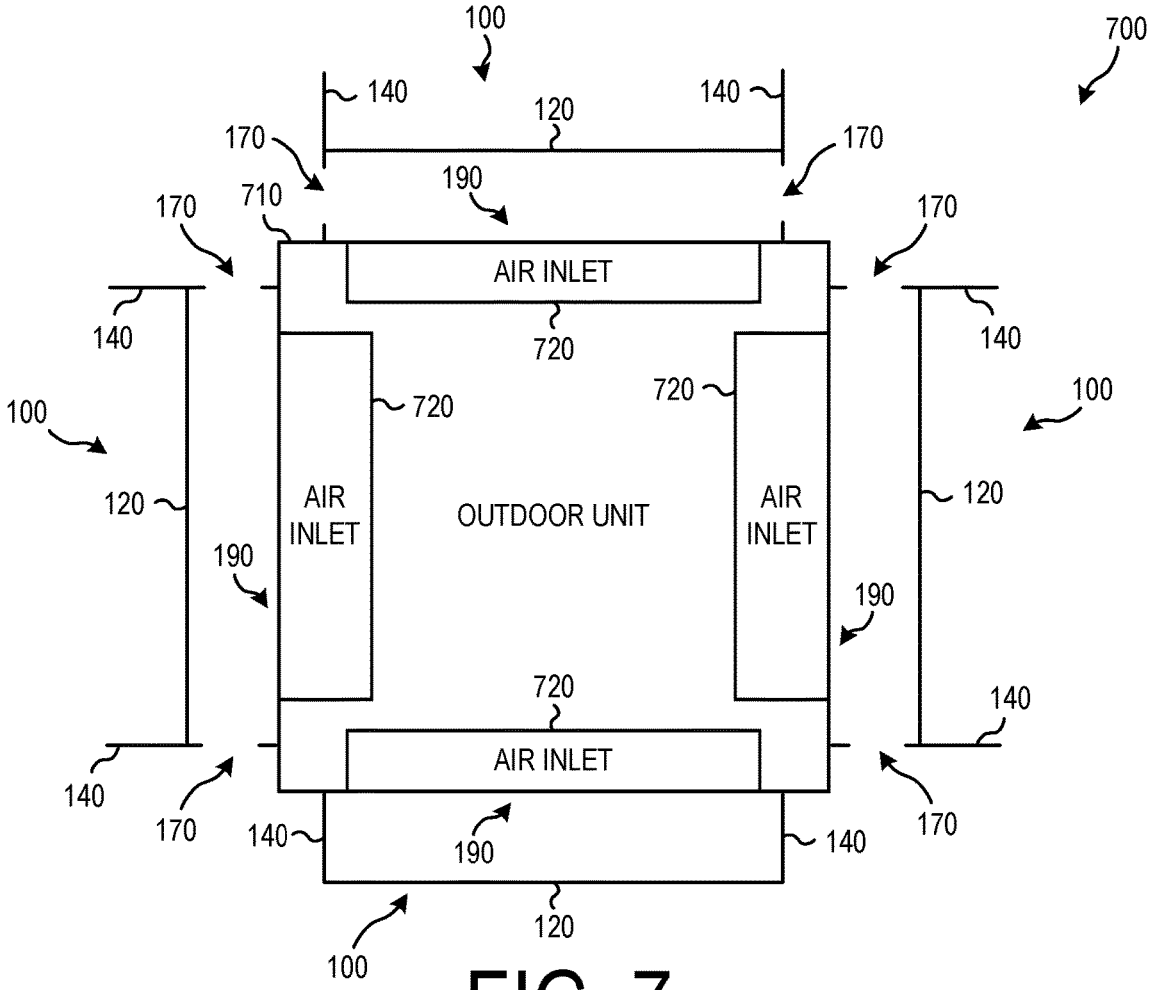
FIG. 7 is a block diagram of an air-conditioning system using the wind baffle of FIG. 1 and having four air inlets according to disclosed embodiments.

FIG. 7 is a block diagram of an air-conditioning system 700 using the wind baffle 100 of FIG. 1 and having four air inlets 720 according to disclosed embodiments.

As shown in FIG. 7, the air-conditioning system 700 includes an outdoor unit 710 having four air inlets 720 on different sides of the outdoor unit 710. A wind baffle 100 is attached adjacent to each air inlet 720. For ease of description the wind baffle 100 at the bottom of the drawing will be referred to as the bottom wind baffle 100, the wind baffle 100 at the top of the drawing will be referred to as the top wind baffle 100, the wind baffle 100 at the left of the drawing will be referred to as the left wind baffle 100, and the wind baffle 100 at the right of the drawing will be referred to as the right wind baffle 100.

The outdoor unit 710 is an outdoor air-conditioning unit that draws outdoor air in through the air inlets 720, passes the outdoor air over a refrigerant coil, exchanges heat between the outdoor air and the refrigerant coil, and then ejects the outdoor air through an air outlet (not shown).

Each wind baffle 100 is secured to the outdoor unit 710 by one or more securing mechanisms 130 (not shown in FIG. 7) such that the vent opening 190 of each wind baffle 100 directly faces a corresponding air inlet 720, and a corresponding back plate 120 is arranged opposite the vent opening 190 such that the back plate 120 prevents air from passing from one side of the back plate into the hollow area within the wind baffle 100, through the vent opening 190, and into the air inlet 720. The only way for air to pass into the hollow area within the wind baffle 100 and through the vent opening 190 into the air inlets 720 is by passing through one or more of the openings 170.

As shown in FIG. 7, this disclosed embodiment employs variable block-off plates for the variable air vents 140. This is by way of example only. Other embodiments could replace the variable air vents 140 with any alternate embodiment suitable for restricting air passing through the openings 170.

Two walls of each wind baffle 100 are shown in the embodiment of FIG. 7. Again, this is by way of example only. Each wind baffle 100 would include at least one other wall that could be a stationary wall 180 or a variable air vent 140. For the sake of simplicity of description, it will be assumed that each of the wind baffles 100 includes four walls, the two opposite walls that are shown being configured as variable air vents 140 and the two opposite walls that are not shown being configured as stationary walls 180. However, this is by way of example only. Alternate embodiments could vary which walls were configured as variable air vents 140 and which walls were configured as stationary walls 180. Also, the number of walls that are variable air vents 140 could be altered.

In the embodiment of FIG. 7, the bottom wind baffle 100 has both variable air vents 140 completely closed. In this configuration, no air can enter into the bottom wind baffle 100.

The left wind baffle 100 has both the variable air vent 140 on the top of the drawing and the variable of air vent 140 on the bottom of the drawing at least partially open. In this configuration, air could enter into the left wind baffle 100 from either of the openings 170 on the top or the bottom, since those openings 170 are at least partially open.

The top wind baffle 100 has both the variable air vent 140 on the left of the drawing and the variable of air vent 140 on the right of the drawing at least partially open. In this configuration, air could enter into the top wind baffle 100 from either of the openings 170 on the left or the right, since those openings 170 are at least partially open.

The right wind baffle 100 has both the variable air vent 140 on the top of the drawing and the variable of air vent 140 on the bottom of the drawing at least partially open. In this configuration, air could enter into the right wind baffle 100 from either of the openings 170 on the top or the bottom, since those openings 170 are at least partially open.

One reason for configuring the variable air vents 140 differently on each of the wind baffles 100 connected to each air inlet 720 is to arrange the wind baffles 100 such that they minimize the amount of wind that blows onto the air inlets 720 during cold weather, since high winds blowing on air inlets 720 during cold weather can reduce the efficiency of the outdoor unit 710.

The particular configurations of the variable air vents 140 on the wind baffles 100 can be set based on knowledge of the prevailing winds surrounding the outdoor unit 710. Information on the prevailing winds can come from wind sensors, weather reports, or any other suitable information source.

The fact that the outdoor unit 710 has four air inlets 720 rather than the two air inlets 220 in the embodiments of FIGS. 2, 4, and 6 is simply a matter of design choice. The disclosed wind baffles 100, 410, 500 can be used with outdoor units having any number of air inlets 220, 720. The wind baffles 100, 410, 500 can be affixed to an outdoor unit 210, 710 regardless of how many air inlets 220, 720 the outdoor unit 210, 710 contains.

Alternate Embodiments

Figure 8:
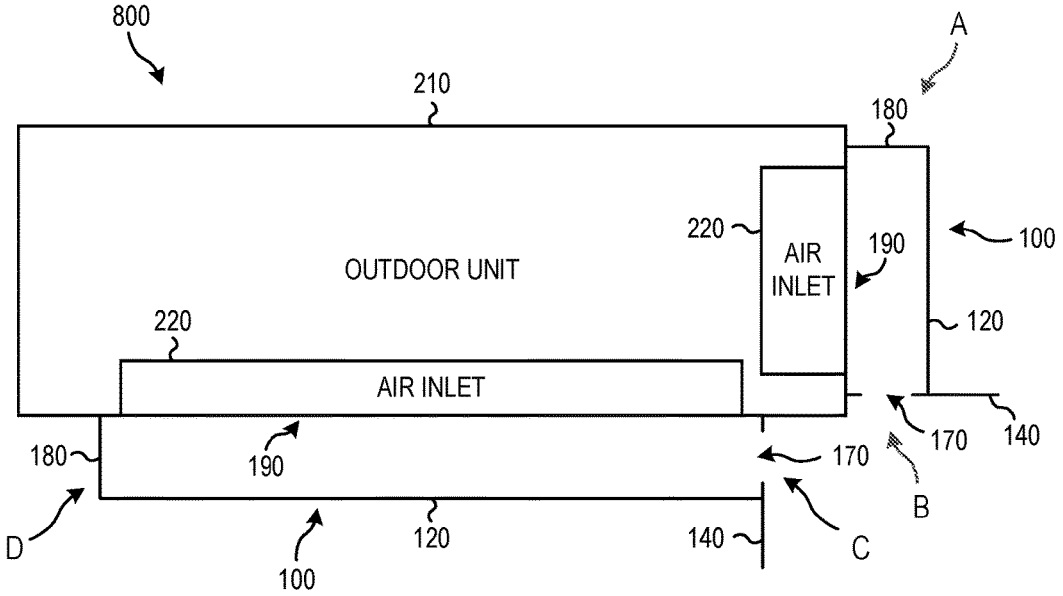
FIG. 8 is a block diagram of an air-conditioning system using a wind baffle having some variable block-off plates and some stationary walls according to disclosed embodiments.

FIG. 8 is a block diagram of an air-conditioning system 800 using a wind baffle 810 having some variable air vents 140 and some stationary walls 180 according to disclosed embodiments. This embodiment shows how the placement of the variable air vents 140 and the stationary walls 180 can vary in different embodiments.

As shown in FIG. 8, the air-conditioning system 800 includes an outdoor unit 210 having two air inlets 220 on different sides of the outdoor unit 210. A wind baffle 100 is attached adjacent to each air inlet 220. For ease of description the wind baffle 100 at the bottom of the drawing will be referred to as the bottom wind baffle 100 and the wind baffle 100 at the right of the drawing will be referred to as the right wind baffle 100.

The outdoor unit 210 is an outdoor air-conditioning unit that draws outdoor air in through the air inlets 220, passes the outdoor air over a refrigerant coil, exchanges heat between the outdoor air and the refrigerant coil, and then ejects the outdoor air through an air outlet (not shown).

Each wind baffle 100 is secured to the outdoor unit 210 by one or more securing mechanisms 130 (not shown in FIG. 8) such that the vent opening 190 of each wind baffle 100 directly faces a corresponding air inlet 220, and a corresponding back plate 120 is arranged opposite the vent opening 190 such that the back plate 120 prevents air from passing from one side of the back plate into the hollow area within the wind baffle 100, through the vent opening 190, and into the air inlet 220. The only way for air to pass into the hollow area within the wind baffle 100 and through the vent opening 190 into the air inlets 220 is by passing through one or more of the openings 170.

As shown in FIG. 8, this disclosed embodiment employs variable block-off plates for the variable air vents 140. This is by way of example only. Alternate embodiments could use any suitable device for the variable air vents 140 and that can partially or fully block an opening 170.

Two walls of each wind baffle 100 are shown in the embodiment of FIG. 8. Again, this is by way of example only. Each wind baffle 100 would include at least one other wall that could be a stationary wall 180 or a variable air vent 140. For the sake of simplicity of description, it will be assumed that each of the wind baffles 100 includes four walls, the two opposite walls that are shown being configured as a variable air vent 140 and a stationary wall 180, and the two opposite walls that are not shown being configured as a variable air vent 140 and a stationary wall 180. However, this is by way of example only. Alternate embodiments could vary which walls were configured as variable air vents 140 and which walls were configured as stationary walls 180.

In the embodiment of FIG. 8, the bottom wind baffle 100 has a stationary wall 180 on the left of the drawing and a variable air vent 140 on the right of the drawing at least partially opened. In this configuration, air could only enter into the bottom wind baffle 100 from the opening 170 on the right side of the drawing, which is left at least partially open. Similarly, the right wind baffle 100 has a stationary wall 180 on the top of the drawing and the variable air vent 140 on the bottom of the drawing at least partially open. In this configuration, air could only enter into the right wind baffle 100 from the opening 170 on the bottom side of the drawing, since that opening 170 is at least partially open.

In the embodiment of FIG. 8, a variable air vent 140 could be provided on either of the other walls of the disclosed wind baffles 100. Such a variable air vent 140 could be fully open, fully closed, or partially opened, as preferable given the prevailing wind conditions.

Dynamically Controlled Variable Air Vents

Although the above embodiments describe situations in which a user will configure a the variable air vents 140, 440, 540 in a wind baffle 100, 410, 500 upon installation, other embodiments can allow for later modifications of the status of the variable air vents 140, 440, 540. In the various wind baffles 100, 410, 500 described above, modifications to the status of the variable air vents 140, 440, 540 may be made by a user at a time after installation. Likewise, it is possible in some embodiments to automatically and dynamically control the configuration of the variable air vents 140, 440, 540 using an air vent controller and wind direction information.

Figure 9:
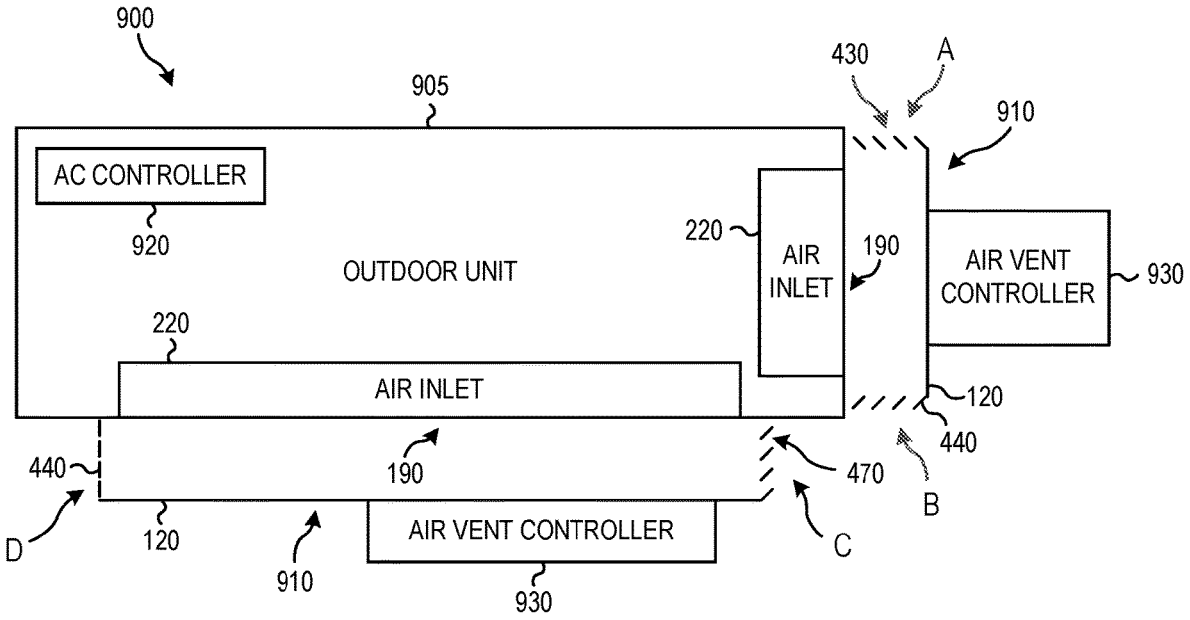
FIG. 9 is a block diagram of an air-conditioning system using a wind baffle having an air vent control circuit to automatically control the operation of the wind baffle according to disclosed embodiments.

FIG. 9 is a block diagram of an air-conditioning system 900 using a wind baffle 910 having in air vent controller 930 to automatically control the operation of the wind baffle 910 according to disclosed embodiments.

As shown in FIG. 9, the air-conditioning system 900 includes an outdoor unit 905 having two air inlets 220 on different sides of the outdoor unit 905 and an air-conditioner controller. A wind baffle 910 is attached adjacent to each air inlet 220. For ease of description the wind baffle 910 at the bottom of the drawing will be referred to as the bottom wind baffle 910 and the wind baffle 910 at the right of the drawing will be referred to as the right wind baffle 910.

Each wind baffle 910 includes a back plate 120, two or more louvers serving as variable air vents 440, two or more openings 470 covered by the variable air vents 440, a vent opening 190, and an air vent controller 930. Although not shown in FIG. 9, each wind baffle 910 will also include a frame 110 and one or more securing mechanisms 130, which are configured as described above with respect to FIG. 1 and serve comparable purposes.

The outdoor unit 905 operates in a manner similar to the outdoor unit 210 of FIG. 2. The two air inlets 220 operate as described above with respect to FIG. 2. The back plate 120 and the vent opening 190 operate as described above with respect to FIG. 1.

The two or more variable air vents 440 are louvers that operate as described above with respect to FIG. 4. The openings 470 are comparable to the openings 170 in the wind baffle 100 of FIG. 1. They operate as described above with respect to FIG. 1.

The air-conditioner controller 920 operates to control the operation of at least the outdoor unit 905. In various embodiments it can send air vent control signals to the air vent controllers 930. The air-conditioner controller 920 may be a microprocessor (e.g., a microcomputer), an application-specific integrated circuit (ASIC), a field-programmable gate array (FPGA), any suitable device for controlling the operation of the elements of the outdoor unit 210.

The air vent controllers 930 operate to control the configuration of an associated wind baffle 910. In various embodiments they can either collect wind direction information internally or receive wind direction information from an external source. Each air vent controller 930 can also receive air vent control signals from an external source such as the air-conditioner controller 920 or a different remote controller or data source. An air vent controller 930 may include a microprocessor (e.g., a microcomputer), an application-specific integrated circuit (ASIC), a field-programmable gate array (FPGA), any suitable device for controlling the operation of the elements of the outdoor unit 210.

The variable air vents 440 in the wind baffle 910 of FIG. 9 are configured as louvers. Louvers can easily be controller on the fly to change their configuration based on the operation of a simple motor. For example, each air vent controller 930 could include a motor attached to the each set of louvers operating as a variable air vent 440 in an associated wind baffle 910. The air vent controller 930 could then operate the motor connected to each variable air vent 440 to rotate the slats between a fully closed position and a fully open position to make the louver change its configuration. However, this is by way of example only. Alternate embodiments that use different mechanisms for the variable air vents 440 can employ different elements in the air vent controller 930 to control the operation of these variable air vents 440.

Figure 10:
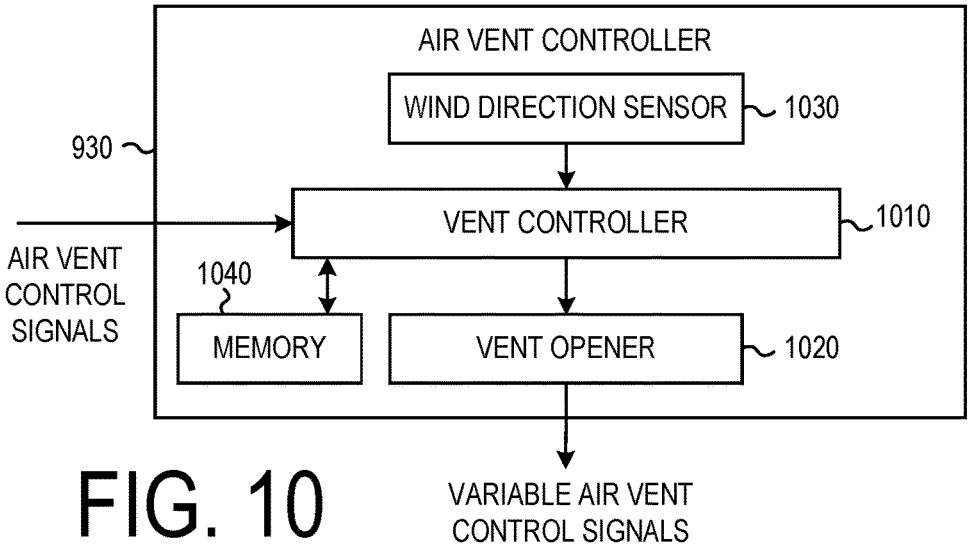
FIG. 10 is a block diagram of an air vent control circuit of FIG. 9 according to disclosed embodiments.

FIG. 10 is a block diagram of the air vent controller 930 of FIG. 9 according to disclosed embodiments. As shown in FIG. 10, the air vent controller 930 includes a vent controller 1010, a vent opener 1020, a wind direction sensor 1030, and a memory 1040.

The vent controller 1010 operates to control the air vent opener 1020 based on air vent control signals and wind direction information. In the embodiment of FIG. 10, the vent control signals come from an external device or user and the wind direction information comes from an internal wind direction sensor. However, this is by way of example only. In alternate embodiments the vent control signals could be generated internally and/or the wind direction information could come from an external source.

The vent controller 1010 may include a microprocessor (e.g., a microcomputer), an application-specific integrated circuit (ASIC), a field-programmable gate array (FPGA), any suitable device for controlling the operation of the vent opener 1020.

The vent opener 1020 is a device configured to alter the configuration of the variable air vents 440 associated with the wind baffle 910 containing the air vent controller 930. In one embodiment the vent opener 1020 can include a plurality of small motors, one associated with each of the variable air vents 440. These motors can operate to move the louvers that make up the variable air vents 440 to switch between a completely open position and a completely closed position, with multiple partially open positions in between. Alternate embodiments that use a different kind of variable air vent 440 could use a different mechanism for the vent opener 1020 as appropriate to the configuration of the variable air vent 440.

The wind direction sensor 1030 operates to determine a wind direction incident on the wind baffle 910 and provide that wind direction information to the vent controller 1010. In various embodiments the wind direction sensor 1030 can be any kind of suitable instrument for detecting a wind direction. In alternate embodiments, the wind direction information can be provided to the vent controller 1010 from an external source.

The memory 1040 can include a static memory (ROM, PROM, EPROM, masked), dynamic memory (RAM, SRAM, DRAM), and/or a hybrid memory (NVRAM, EEPROM, Flash) that holds information used by the vent controller 1010. This can include program information for operating the vent controller 1010, data used by the vent controller 1010 (e.g. previous wind direction information), technical information used by the vent controller 1010 to determine an optimal configuration for the wind baffle 910, etc.). In various embodiments, the memory 1040 can include a flash drive, a solid-state drive, a magnetic or optical disk drive, or any suitable memory device.

In operation, the wind direction sensor 1030 will detect the wind direction incident on the wind baffle 910. The vent controller 1010 will then receive this information and determine, based on the current wind direction, what the best configuration will be for the variable air vents 440 in its wind baffle 910 to maximize the efficiency of the outdoor unit 905. The vent controller 1010 then instructs the vent opener 1020 to alter the configuration of the variable air vents 440 in the wind baffle 910 such that they take on the desired configuration determined by the vent controller 1010. In the alternative, the vent controller 1010 can alter the configuration of the variable air vents 440 based on air vent control signals received from an external source.

In this way, the wind baffle 910 can dynamically account for variable winds. Thus, if the prevailing winds are from the south during the morning, from the east during the afternoon, and from the northeast in the evening, the wind baffle 910 can take on different configurations at different times during the day, further increasing the efficiency of the outdoor unit 905.

Absent dynamic control, a user will have to set a wind baffle 100, 410, 500, 910 in a single configuration that takes into account the most common prevailing wind direction and leave it in place until the user can manually alter it.

Although FIG. 10 discloses that the variable air vents 440 are configured as louvers, this is by way of example only. The variable air vents 440 could be configured as any suitable mechanism that can selectively and automatically open or close an opening 170, 470, 570 in a wind baffle 100, 410, 500, 910. In such an alternate embodiment, the vent opener 1020 would be modified accordingly such that it properly controlled the open/closed configuration of the variable air vents 440.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed:

1. A wind baffle operable to control movement of air to an air inlet of an air-conditioner, the wind baffle comprising:

a frame defining an inlet side, an outdoor side opposite the inlet side, and a plurality of wall sections between the inlet side and the outdoor side;

a back plate formed on the outdoor side such that air cannot pass through the outdoor side;

a first variable air vent formed on a first of the plurality of wall sections, the first variable air vent being configured to selectively pass or restrict a first air flow though the first variable air vent;

a second variable air vent formed on a second of the plurality of wall sections different from the first of the plurality of wall sections, the second variable air vent being configured to selectively pass or restrict a second air flow though the second variable air vent; and a securing mechanism on the inlet side configured to attach the wind baffle to the air inlet such that the inlet side directly faces the air inlet, wherein the inlet side is unobstructed, allowing air to pass freely.

2. The wind baffle of claim 1, wherein the first variable air vent includes a variable block-off plate configured to take one of a plurality of configurations, each of the plurality of configurations allowing a different amount of air to flow through the first variable air vent.

3. The wind baffle of claim 2, wherein the variable block-off plate further comprises:

a positioner configured to allow the variable block-off plate to move between the plurality of configurations; and a fastener to secure the variable block-off plate in one of the plurality of configurations.

4. The wind baffle of claim 3, wherein the positioner is one of a linear opening in the variable block-off plate, a bolt hole, and a protrusion configured to rest in a corresponding indentation.

5. The wind baffle of claim 1, wherein the first variable air vent includes an array of louvers configured to take one of a plurality of configurations, each of the plurality of configurations representing a differing degree of opening and allowing a different amount of air to flow through the array of louvers.

6. The wind baffle of claim 1, wherein
the first variable air vent further comprises:
an opening configured to allow passage of air; and
a plurality of slats formed to cover the opening, and
the plurality of slats are configured such that one or more of the plurality of slats can be removed from the first variable air vent to increase air flow through the first air vent.

7. The wind baffle of claim 6, wherein
the plurality of slats are configured such that the plurality of slats can be removed from the first variable air vent and can be replaced on the first variable air vent after removal.

8. The wind baffle of claim 6, wherein
the plurality of slats are configured such that removal of one of the plurality of slats from the first variable air vent cannot be reversed.

9. The wind baffle of claim 1, further comprising:
a baffle control circuit configured to automatically control at least one of the first and second variable air vents.

10. The wind baffle of claim 9, wherein
the baffle control circuit includes a wind direction sensor configured to detect a wind direction around the wind baffle, and
the baffle control circuit is configured to automatically control at least one of the first and second variable air vents based on the detected wind direction around the wind baffle.

11. The wind baffle of claim 9, wherein
the baffle control circuit operates in response to baffle control signals received from an air-conditioner controller.

12. An air-conditioning system, comprising:
an outdoor air-conditioner having two or more air inlets for drawing in air, the two or more air inlets each being formed on different sides of the outdoor air-conditioner;
a first wind baffle secured to a first air inlet selected from the two or more air inlets such that the first wind baffle completely covers the first air inlet,
wherein
the first wind baffle further comprises
a first frame defining a first inlet side, a first outdoor side opposite the first inlet side, and a first plurality of wall sections between the first inlet side and the first outdoor side;
a first back plate formed on the first outdoor side such that air cannot pass through the first outdoor side;
a first variable air vent formed on a first of the plurality of first wall sections, the first variable air vent being configured to selectively pass or restrict a first air flow though the first variable air vent;
a second variable air vent formed on a second of the first plurality of wall sections different from the first of the plurality of wall sections, the second variable air vent being configured to selectively pass or restrict a second air flow though the second variable air vent; and
a first securing mechanism on the first inlet side configured to attach the first wind baffle to the first air inlet such that the first inlet side directly faces the first air inlet,
wherein
the first inlet side is unobstructed, allowing air to pass freely.

13. The air-conditioning system of claim 12, wherein
the first variable air vent includes a variable block-off plate configured to take one of a plurality of configurations, each of the plurality of configurations allowing a different amount of air to flow through the first variable air vent.

14. The air-conditioning system of claim 12, wherein the variable block-off plate further comprises:
a positioner configured to allow the variable block-off plate to move between the plurality of configurations; and
a fastener to secure the variable block-off plate in one of the plurality of configurations.

15. The air-conditioning system of claim 12, wherein
the positioner is one of a linear opening in the variable block-off plate, a bolt hole, and a protrusion configured to rest in a corresponding indentation.

16. The air-conditioning system of claim 12, wherein
the first variable air vent includes an array of louvers configured to take one of a plurality of configurations, each of the plurality of configurations representing a differing degree of opening and allowing a different amount of air to flow through the array of louvers.

17. The air-conditioning system of claim 12, wherein the first variable air vent further comprises:
an opening configured to allow passage of air; and
a plurality of slats formed to cover the opening,
wherein
the plurality of slats are configured such that one or more of the plurality of slats can be removed from the first variable air vent to increase air flow through the first air vent.

18. The air-conditioning system of claim 17, wherein
the plurality of slats are configured such that the plurality of slats can be removed from the first variable air vent and can be replaced on the first variable air vent after removal.

19. The air-conditioning system of claim 17, wherein
the plurality of slats are configured such that removal of one of the plurality of slats from the first variable air vent cannot be reversed.

20. The air-conditioning system of claim 12, further comprising:
a baffle control circuit configured to automatically control operation of the first variable air vent.

21. The air-conditioning system of claim 20, wherein
the baffle control circuit includes a wind direction sensor configured to detect a wind direction around the first wind baffle, and
the baffle control circuit is configured to automatically control at first air vent based on the detected wind direction around the first wind baffle.

22. The air-conditioning system of claim 12, further comprising
an air-conditioner controller configured to control operation of the air-conditioning system,
wherein
the baffle control circuit operates in response to baffle control signals received from the air-conditioner controller.

23. The air-conditioning system of claim 12, further comprising
a second wind baffle secured to a second air inlet selected from the two or more air inlets such that the second wind baffle completely covers the second air inlet, wherein the second wind baffle further comprises:

a second frame defining a second inlet side, a second outdoor side opposite the second inlet side, and a second plurality of wall sections between the second inlet side and the second outdoor side;

a second back plate formed on the second outdoor side such that air cannot pass through the second outdoor side;

a third variable air vent formed on a first of the plurality of second wall sections, the third variable air vent being configured to selectively pass or restrict a third air flow through the third variable air vent;

a fourth variable air vent formed on a second of the second plurality of wall sections different from the first of the second plurality of wall sections, the fourth variable air vent being configured to selectively pass or restrict a second air flow through the fourth variable air vent; and a second securing mechanism on the second inlet side configured to attach the second wind baffle to the second air inlet such that the second inlet side directly faces the second air inlet, and the second inlet side is unobstructed, allowing air to pass freely.

24. The air-conditioning system of claim 12, further comprising a second wind baffle secured to a second air inlet selected from the two or more air inlets such that the second wind baffle completely covers the second air inlet, wherein the second wind baffle entirely prevents air flow through the second air inlet.

* * * * *